US011662079B1

(12) United States Patent
Parker et al.

(10) Patent No.: US 11,662,079 B1
(45) Date of Patent: May 30, 2023

(54) SYSTEMS AND METHODS FOR EMULATING NATURAL DAYLIGHT WITH AN INTERIOR LUMINAIRE

(71) Applicant: Samsung Electronics Company, Ltd., Suwon-si (KR)

(72) Inventors: Ian David Parker, Santa Barbara, CA (US); Ivan Ashton France, Saratoga, CA (US); Kishore Rathinavel, Cupertino, CA (US); William Augustus Workman, San Francisco, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/706,395

(22) Filed: Mar. 28, 2022

(51) Int. Cl.

| | |
|---|---|
| ***F21V 9/02*** | (2018.01) |
| ***F21V 14/06*** | (2006.01) |
| ***F21V 17/02*** | (2006.01) |
| ***F21V 14/02*** | (2006.01) |
| ***F21V 23/00*** | (2015.01) |
| ***F21V 9/40*** | (2018.01) |
| *F21Y 113/10* | (2016.01) |
| *F21Y 115/10* | (2016.01) |

(52) U.S. Cl.
CPC ..... *F21V 9/02* (2013.01); *F21V 9/40* (2018.02); *F21V 14/02* (2013.01); *F21V 14/06* (2013.01); *F21V 17/02* (2013.01); *F21V 23/003* (2013.01); *F21Y 2113/10* (2016.08); *F21Y 2115/10* (2016.08)

(58) Field of Classification Search
CPC ... F21V 9/02; F21V 9/40; F21V 14/02; F21V 14/06; F21V 17/02; F21V 23/003
See application file for complete search history.

(56) References Cited

U.S. PATENT DOCUMENTS

| | | | | |
|---|---|---|---|---|
| 9,191,131 | B2 | 11/2015 | Berkmann | |
| 9,476,567 | B2 | 10/2016 | Hendrikus | |
| 9,668,312 | B2 | 5/2017 | Meerbeek | |
| 10,465,869 | B2 | 11/2019 | Keller | |
| 10,775,022 | B2 | 9/2020 | Di Trapani | |
| 2018/0059474 | A1* | 3/2018 | Yamauchi | G02F 1/13 |
| 2018/0279454 | A1* | 9/2018 | Takeshita | H05B 47/105 |
| 2019/0101263 | A1* | 4/2019 | Di Trapani | F21S 8/024 |
| 2020/0003393 | A1* | 1/2020 | Takeshita | F21S 8/026 |
| 2020/0056754 | A1* | 2/2020 | Di Trapani | F21V 3/049 |
| 2020/0077485 | A1* | 3/2020 | Hu | F21V 9/02 |

* cited by examiner

*Primary Examiner* — Jong-Suk (James) Lee
*Assistant Examiner* — Christopher E Dunay

(57) ABSTRACT

In one embodiment, the disclosure provides an interior luminaire system for emulating natural daylight. The system may include an artificial sunlight system and an artificial skylight system. The artificial sunlight system may include one or more first light sources and one or more first movable lenses paired with the first light sources, respectively. Each first light source may be configured to direct light only at the respective paired lens. Each first light source-lens pair may be operable to generate a set of substantially parallel rays of light. The artificial sunlight system may be operable to generate a movable substantially collimated beam of light comprising the sets of substantially parallel rays of light. The artificial skylight system may include one or more second light sources. Each second light source may be operable to generate omnidirectional rays of light. The artificial skylight system may be operable to generate diffuse illumination.

20 Claims, 14 Drawing Sheets

E5: The restricted emission cone of the sunlight.

E6: The scattered, omnidirectional emission of the skylight.

E4: Mechanical assembly that restricts the emission angle of the Sun LEDs. Material may be transparent with a reflective coating on the inside.

E5: The restricted emission cone of the sunlight.

E6: The scattered, omnidirectional emission of the skylight.

SYSTEMS AND METHODS FOR EMULATING NATURAL DAYLIGHT WITH AN INTERIOR LUMINAIRE

TECHNICAL FIELD

This disclosure relates generally to home appliances, and in particular relates to emulating natural daylight with an interior luminaire.

BACKGROUND

Exposure to sunshine has been demonstrated to improve the sense of wellbeing and health; sunlight causes the body to release hormones, particularly serotonin, a key hormone that stabilizes our mood, feelings of well-being, and happiness. However, there are many places where having access to a sunlit window is simply impossible: for example, in the middle of large buildings, in basement rooms, or at high latitudes in winter when the sun sets early. Indeed, 4-6% of people are significantly affected by lack of sunlight—particularly in the winter months—due to a condition called Seasonal Affective Disorder (SAD).

DESCRIPTION OF EXAMPLE EMBODIMENTS

Control System Overview

Figure 1:
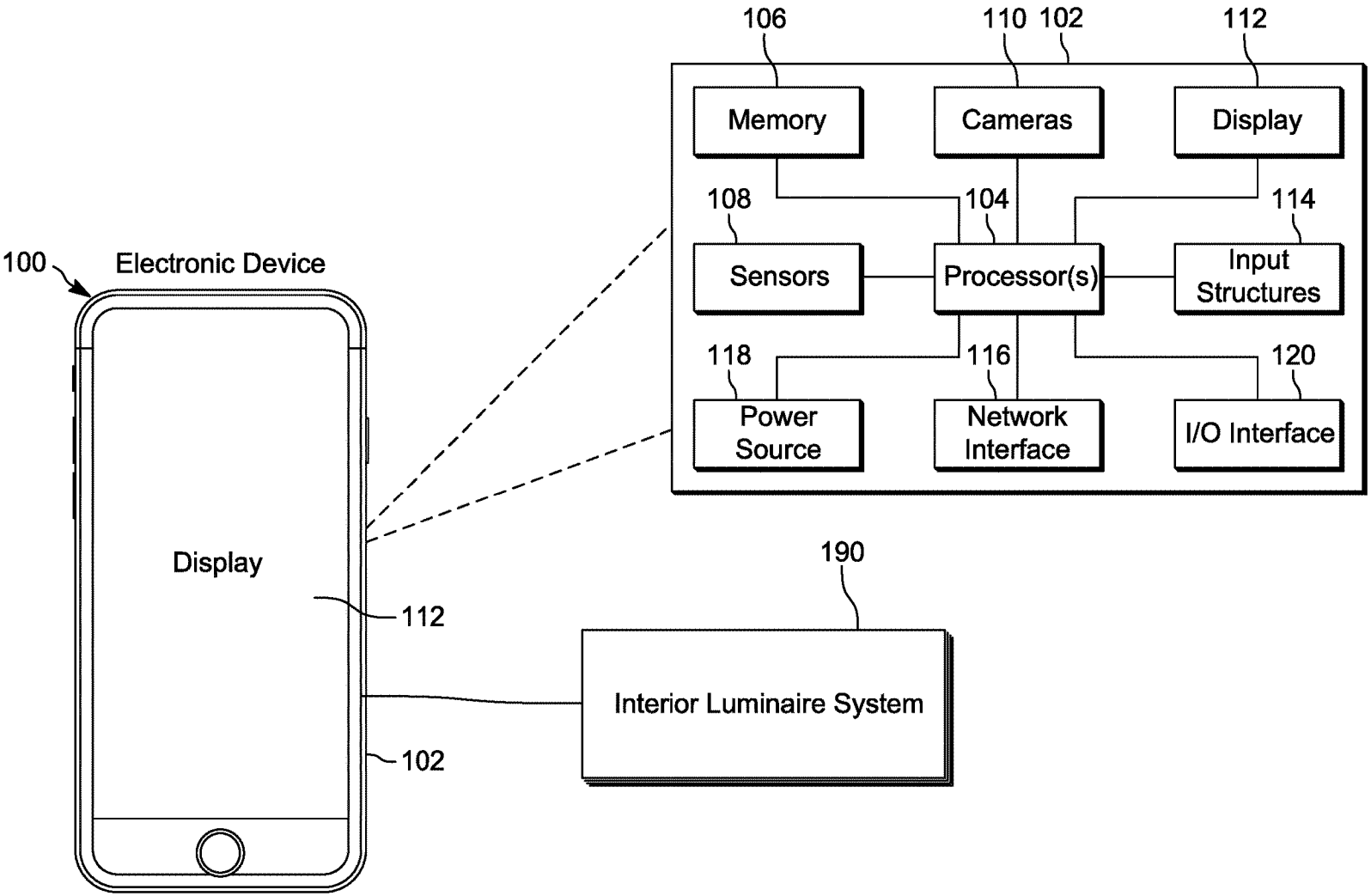
FIG. 1 illustrates an example electronic device.

FIG. 1 illustrates an example electronic device 100. In particular embodiments, the electronic device 100 may include, for example, any of various personal electronic devices 102, such as a mobile phone electronic device, a tablet computer electronic device, a laptop computer electronic device, and so forth. In particular embodiments, as further depicted by FIG. 1, the personal electronic device 102 may include, among other things, one or more processor(s) 104, memory 106, sensors 108, cameras 110, a display 112, input structures 114, network interfaces 116, a power source 118, and an input/output (I/O) interface 120. It should be noted that FIG. 1 is merely one example of a particular implementation and is intended to illustrate the types of components that may be included as part of the electronic device 100.

In particular embodiments, the one or more processor(s) 104 may be operably coupled with the memory 106 to perform various algorithms, processes, or functions. Such programs or instructions executed by the processor(s) 104 may be stored in any suitable article of manufacture that includes one or more tangible, computer-readable media at least collectively storing the instructions or routines, such as the memory 106. The memory 106 may include any suitable articles of manufacture for storing data and executable instructions, such as random-access memory (RAM), read-only memory (ROM), rewritable flash memory, hard drives, and so forth. Also, programs (e.g., an operating system) encoded on such a computer program product may also include instructions that may be executed by the processor (s) 104 to enable the electronic device 100 to provide various functionalities.

In particular embodiments, the sensors 108 may include, for example, one or more cameras (e.g., depth cameras), touch sensors, microphones, motion detection sensors, thermal detection sensors, light detection sensors, time of flight (ToF) sensors, ultrasonic sensors, infrared sensors, or other similar sensors that may be utilized to detect various user inputs (e.g., user voice inputs, user gesture inputs, user touch inputs, user instrument inputs, user motion inputs, and so forth). The cameras 110 may include any number of cameras (e.g., wide cameras, narrow cameras, telephoto cameras, ultra-wide cameras, depth cameras, and so forth) that may be utilized to capture various 2D and 3D images. The display 112 may include any display architecture (e.g., AMLCD, AMOLED, micro-LED, and so forth), which may provide further means by which users may interact and engage with the electronic device 100. In particular embodiments, as further illustrated by FIG. 1, one more of the cameras 110 may be disposed behind, underneath, or alongside the display 112 (e.g., one or more of the cameras 110 may be partially or completely concealed by the display 112), and thus the display 112 may include a transparent pixel region and/or semi-transparent pixel region through which the one or more concealed cameras 110 may detect light, and, by extension, capture images. It should be appreciated that the one more of the cameras 110 may be disposed anywhere behind or underneath the display 110, such as at a center area behind the display 110, at an upper area behind the display 110, or at a lower area behind the display 110.

In particular embodiments, the input structures 114 may include any physical structures utilized to control one or more global functions of the electronic device 100 (e.g., pressing a button to power "ON" or power "OFF" the electronic device 100). The network interface 116 may include, for example, any number of network interfaces suitable for allowing the electronic device 100 to access and receive data over one or more cloud-based networks (e.g., a cloud-based service that may service hundreds or thousands of the electronic device 100 and the associated users corresponding thereto) and/or distributed networks. The power source 118 may include any suitable source of power, such as a rechargeable lithium polymer (Li-poly) battery and/or an alternating current (AC) power converter that may be utilized to power and/or charge the electronic device 100 for operation. Similarly, the I/O interface 120 may be provided to allow the electronic device 100 to interface with various other electronic or computing devices, such as one or more auxiliary electronic devices.

In particular embodiments, the electronic device 100 is a mobile device or remote-control device that is programmed to communicate with an interior luminaire system 190 that comprises a compatible I/O interface. In other particular embodiments, the electronic device 100 is not a mobile device, but is instead integrated into the interior luminaire system 190. As an example, and not by way of limitation, any of the one or more processors 104, the memory 106, the I/O interface 120, or other components of the electronic device may be integrated into a system on a chip (SoC), which is further integrated into the interior luminaire system 190. In particular embodiments, the electronic device 100 may be used to control the interior luminaire system 190. As an example, and not by way of limitation, the electronic device 100 may be programmed to control the operation of one or more light sources and one or more lenses of the interior luminaire system, as explained herein with greater specificity. As an example, and not by way of limitation, the electronic device 100 may be programmed to control the orientation of one or more light sources or lenses, or the quality, color, or other characteristics of the light emitted from the one or more light sources. As an example, and not by way of limitation, the electronic device 100 may be programmed to control a movable beam of light, as further explained herein. Although this disclosure describes the electronic device 100 controlling the interior luminaire system 190 in a particular manner, this disclosure contemplates the electronic device 100 controlling the interior luminaire system 190 in any suitable manner, in accordance with the various embodiments of the interior luminaire system 190.

Interior Luminaire System for Emulating Natural Daylight

In particular embodiments, this disclosure provides a luminaire which mimics a window with realistic sunshine, and which may be used for places or times when it would otherwise be impossible to have natural light. Such a luminaire could have wide application as an aid to improving health and wellness for individuals without adequate access to natural daylight. In particular embodiments, the luminaire may emulate natural daylight by providing emulated sunlight using one or more first light sources and emulated skylight using one or more second light sources.

In particular embodiments, an intense beam of light can be generated by an array of light sources in combination with a (parallel) array of lenses. The light sources can be placed at the focus of the lenses so that the emerging light is collimated—producing a beam, the size of the lens, which diverges only slightly. Each light source may 'talk' to substantially only one lens. The array of 'beams'—one from each lens, may be parallel and generate a field of intense, parallel beams. By moving the relative position of the lens and source, the direction of the beam can be steered to emulate the movement of the sun. An observer looking into the light field may perceive a source that appears to be at infinity, and that appears to move if the observer does (the parallax effect). A color-tunable source can be used for emulating the solar spectrum and the color change throughout the day—e.g. a LED that has an emission close to that of a black-body and can be color-tuned along the black-body curve.

Figure 2B:
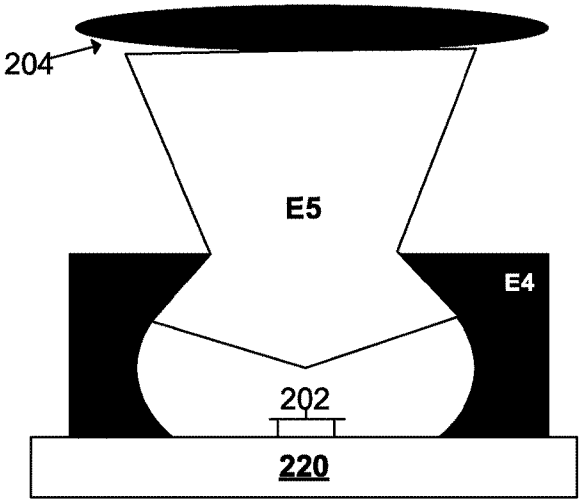
FIG. 2B illustrates a close-up view of a first light source of FIG. 2A emitting a cone of light onto a lens of FIG. 2A through restriction by a mechanical assembly.
Figure 2A:
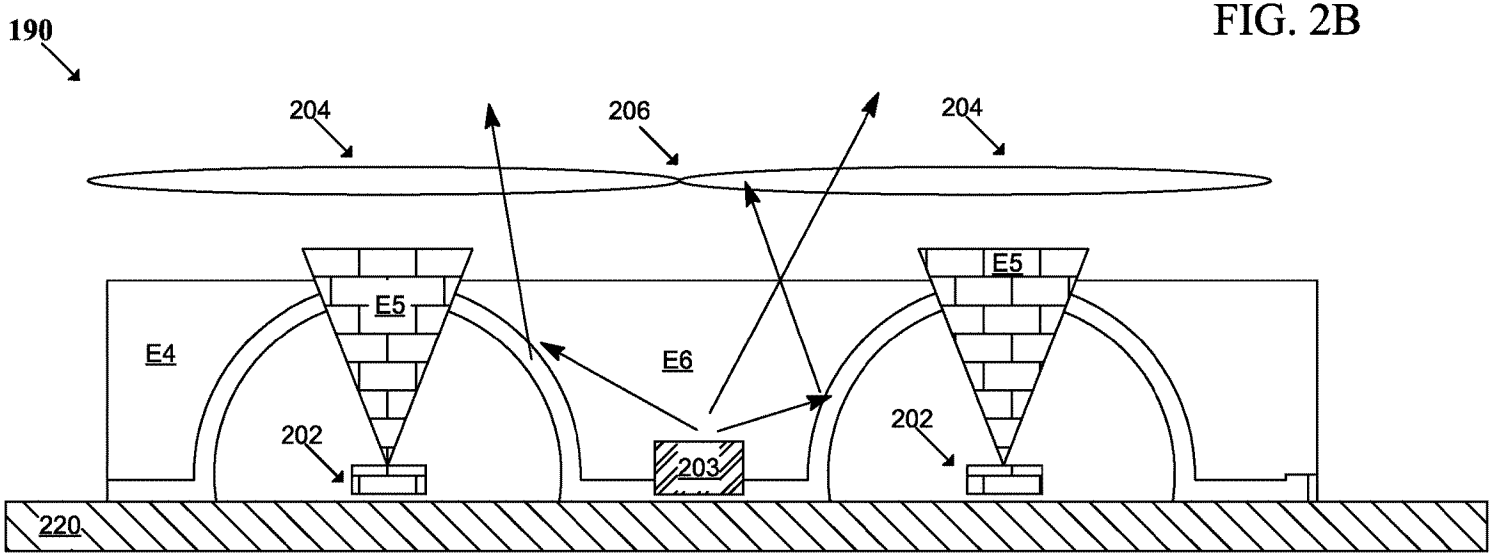
FIG. 2A illustrates an example interior luminaire system.

FIG. 2A illustrates an example interior luminaire system 190. In particular embodiments the first light sources 202 and second light sources 203 may be arranged on a circuit board 220. In particular embodiments, to provide the emulated sunlight, the luminaire 190 may also use one or more lenses 204 to collimate light from the first light sources 202, thereby producing parallel rays of light. As depicted in FIG. 2A, the one or more lenses 204 may be arranged into a lens array 206, which may be steerable. The lenses 204 should have a positive focal-length, but can be of any style, e.g. Fresnel lenses or conventional lenses, and can be single- or multi-element.

In particular embodiments, the interior luminaire system 190 can emit an intense, movable, substantially collimated beam of light that casts convincing shadows and exhibits a correct parallax effect, appearing to be at infinity. As an example, and not by way of limitation, the illuminance level emitted may be over 100,000 lux at midday. In particular embodiments, the electronic device 100 may be programmed to control the interior luminaire system 190 to change the direction of the beam throughout the day, mimicking the movement of the sun. In particular embodiments, the color of the emulated sunlight can also be changed over the course of the day, such that it is different at noon compared with early morning and late afternoon. In particular embodiments, the electronic device 100 can be programmed to subtly change the quality of emulated sunlight such that it is more diffused early and late in the day. Moreover, the electronic device 100 can be programmed to vary the angle and intensity of the emulated sunlight according to the time of day and the season. In particular embodiments, the spectrum of the emulated sun light can closely mimic the actual spectrum of sunlight. In addition, the luminaire system 190 may emit emulated skylight light from an artificial 'sky'. In particular embodiments, the 'skylight' is not collimated, but instead is omnidirectional and provides diffuse illumination without casting substantial shadows. In particular embodiments, the electronic device 100 can be programmed to change the sky color change throughout day. In particular embodiments, the emulated skylight can mimic cloudy or overcast conditions. In particular embodiments, the interior luminaire system 190 can be window sized. As an example, and not by way of limitation, the interior luminaire system 190 can be a minimum of about 24"×36" with a depth of no more than 6" such that it can retrofit existing walls or ceilings.

As used herein, "sunlight" may refer to the light provided by the sun during the daytime hours.

As used herein, "skylight" may refer to the light provided by the sky during the daytime hours. Skylight generally appears blue, although its color may vary throughout the day.

As used herein, "daylight" may refer to the light provided by the sun and the sky during the daytime hours, daylight being comprised of sunlight and skylight.

As used herein, "light source" may refer to any artificial source of light. As an example, and not by way of limitation, a light-emitting diode (LED) is a light source. As another example, and not by way of limitation, a liquid-crystal display (LCD) is a light source. Although this disclosure describes particular artificial sources of light being used as light sources, this disclosure contemplates any suitable artificial sources of light being used as light sources.

Certain technical challenges exist for emulating natural daylight. One technical challenge may include generating a substantially collimated beam of light to emulate sunlight. One solution presented by the embodiments disclosed herein to address this challenge may be to use an array of light sources paired with an array of lenses to generate sets of parallel beams of light that together form a substantially collimated beam of light. Another technical challenge may include generating diffuse illumination that changes color over time to emulate natural skylight. One solution presented by the embodiments disclosed herein to address this challenge may be to use color-tunable LEDs and adjusting the color of the LEDs with computer programming.

Certain embodiments disclosed herein may provide one or more technical advantages. A technical advantage of the embodiments may include providing skylight that is not collimated, but instead is omnidirectional and provides diffuse illumination without casting shadows. Another technical advantage of the embodiments may include providing artificial sunlight that casts convincing shadows. Certain embodiments disclosed herein may provide none, some, or all of the above technical advantages. One or more other technical advantages may be readily apparent to one skilled in the art in view of the figures, descriptions, and claims of the present disclosure.

In particular embodiments, the interior luminaire system 190 may comprise an artificial sunlight system comprising one or more first light sources 202 and one or more first movable lenses 204 paired with the one or more of the first light sources 202, respectively. As an example, and not by way of limitation, the one or more of the first light sources 202 may each comprise a color-tunable light emitting diode (LED). Each of these LEDs may be tunable to emulate a solar spectrum by changing, over a pre-determined time, a respective emission color of each LED within an approximate black-body curve. In particular embodiments, the electronic device 100 may be programmed to adjust the emission color of these LEDs to accurately match the diurnal changes in the solar color over the course of a day. As another example, and not by way of limitation, the first light sources 202 may comprise color-changing incandescent bulbs, which naturally emit a black-body spectrum, in combination with a color wheel to mimic the diurnal variation. Although this disclosure describes particular first light sources 202 being adjusted in a particular manner, this disclosure contemplates any suitable first light sources 202 being adjusted in any suitable manner.

Figure 3:
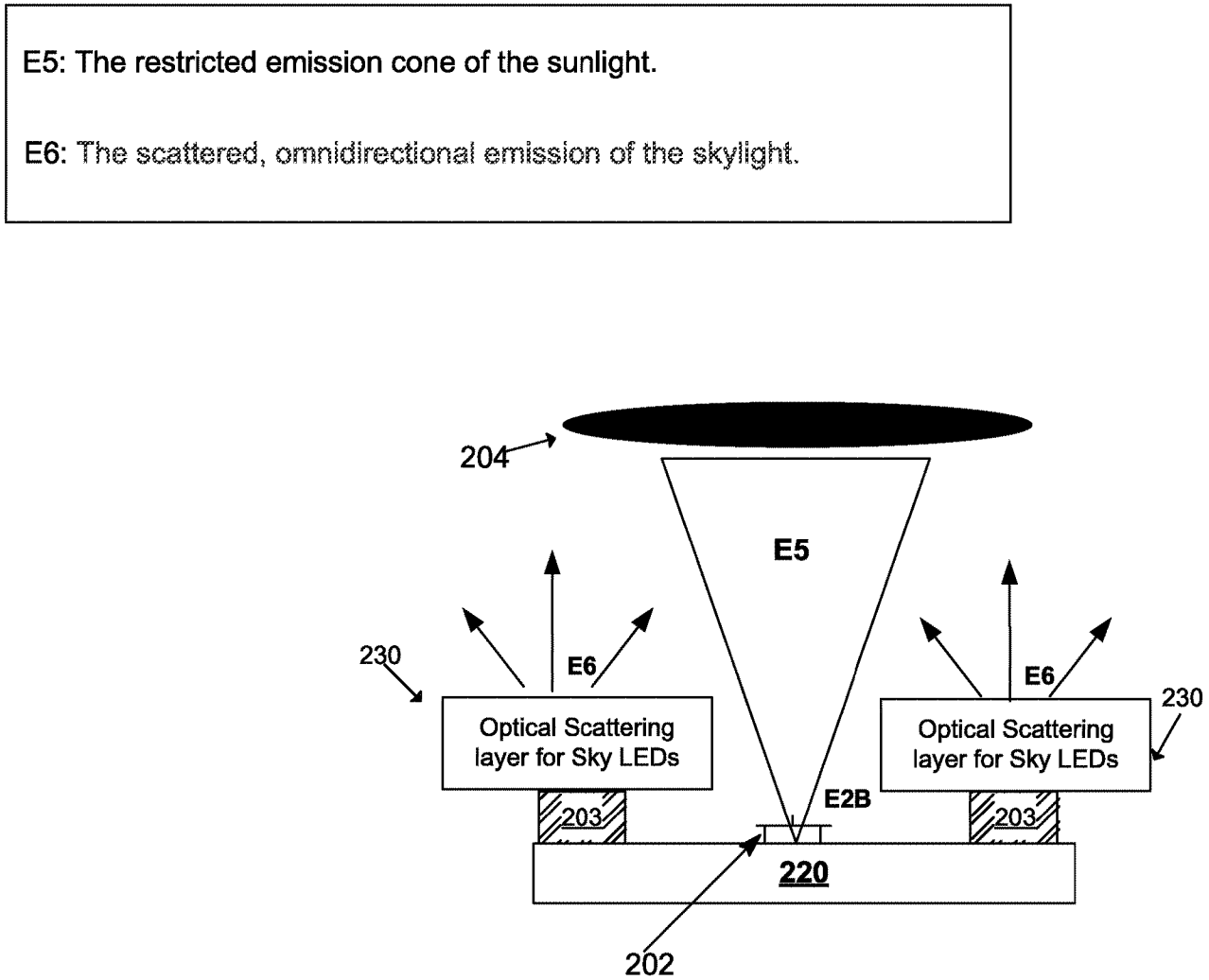
FIG. 3 illustrates a first light source comprising an integral lens that can restrict the emission angle of the first light source so that it directs light only at the lens with which it is paired.

In particular embodiments, each first light source 202 is configured to direct light only at the lens 204 with which it is respectively paired. FIG. 2A depicts one method of directing the light from the first light sources 202 to the paired lenses 204, which is by using a mechanical assembly E3 that restricts the emission angle of the first light sources 202. In particular embodiments, the mechanical assembly E3 may be made of a transparent material and feature a reflective coating on its interior. FIG. 2B illustrates a close-up view of a first light source 202 of FIG. 2A emitting a cone of light E5 onto a lens 204 of FIG. 2A through restriction by the mechanical assembly E4. On the other hand, FIG. 3 illustrates a first light source 202 comprising an integral lens that can restrict the emission angle of the first light source 202 so that it directs light only at the lens 204 with which it is paired. As an example, and not by way of limitation, an integral lens of a first light source may restrict an emission angle of that light source to +−15 degrees. In such embodiments, the one or more second light sources 203, which may also be LEDs, may be operable to emit diffuse illumination through one or more optical scattering layers 230. Although this disclosure describes restricting the first light sources 202 to direct light onto paired lenses 204 in particular ways, this disclosure contemplates restricting the first light sources 202 to direct light onto paired lenses 204 in any suitable ways.

Figure 4:
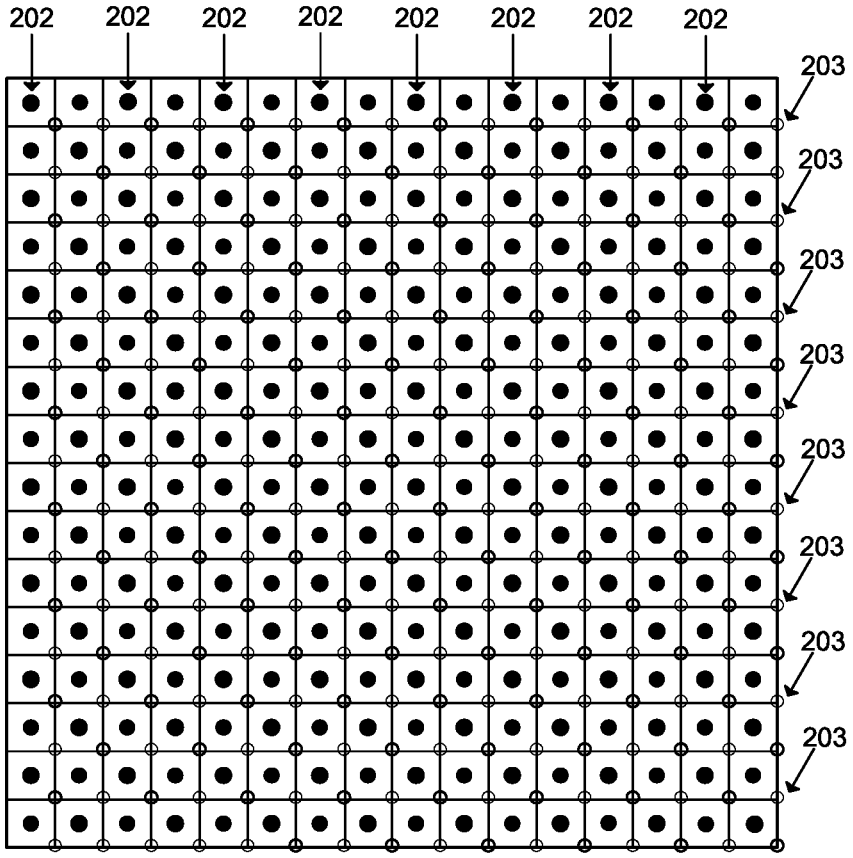
FIG. 4 illustrates an array of first light sources and second light sources, wherein the first light sources are positioned at the focal points of the lenses and second light sources are positioned outside of a focal area of the lenses.

In particular embodiments, the one or more first light sources 202 and the one or more second light sources 203 comprise color-tunable light emitting diodes (LEDs) positioned in an array. FIG. 4 illustrates an array of first light sources 202 and second light sources 203, wherein the first light sources 202 are positioned at the focal points of the lenses 204 and second light sources 203 are positioned outside of a focal area of the lenses. Although the depiction of FIG. 4 is 2-dimensional, the center of the lenses 204 could be positioned approximately directly above the first light sources 202. Thus, in particular embodiments, the lenses 204 of a lens array 206 could be positioned intersect above the second light sources 203. In particular embodiments, the lenses 204 could therefore collimate the light of the first light sources 202, thereby generating sets of parallel rays of light. On the other hand, in particular embodiments, because the light of the second light sources 203 would not be focused by the lenses 204, the second light sources 203 could simultaneously generate diffuse illumination as the light of the second light sources 203 could pass through the lenses 204 at a wide variety of angles and be subsequently scattered in an omnidirectional emission pattern. Although this disclosure describes arranging first light sources 202 and second light sources 203 in particular patterns and arrays, this disclosure contemplates arranging first light sources 202 and second light sources 203 in any suitable arrangement.

Figure 5:
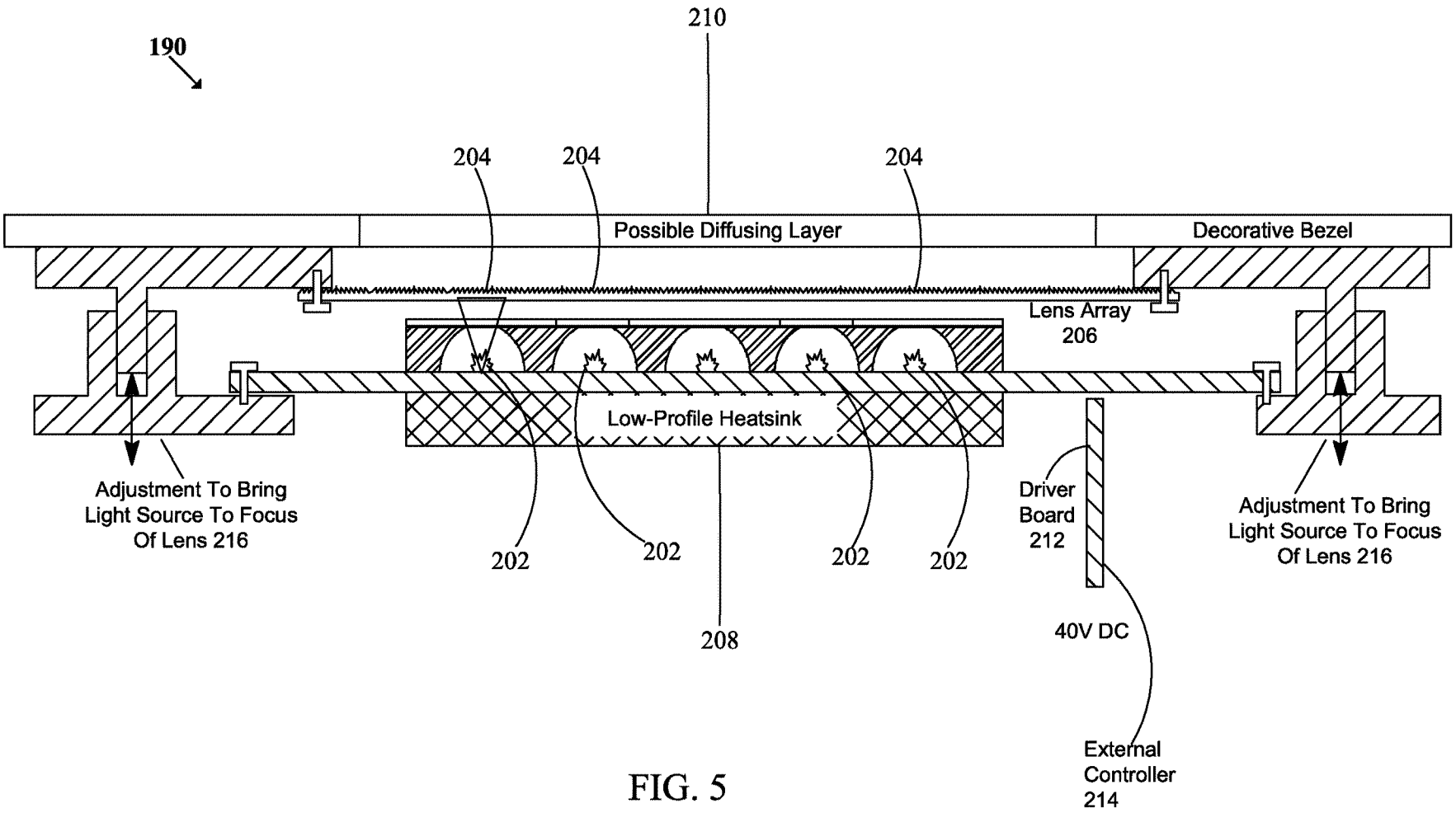
FIG. 5 illustrates a second example interior luminaire system.

FIG. 5 illustrates a second example interior luminaire system. As depicted in FIG. 5, in particular embodiments, the one or more first movable lenses 204 can be positioned in a lens array 206, wherein the lens array 206 is steerable and can translate with at least two degrees of freedom, and wherein the artificial sunlight system is operable to move the substantially collimated beam of light by steering the lens array 206. In particular embodiments, one or more adjustment mechanisms 216 may be operable to move each first light 202 source to a position relative to the first movable lens 204 with which it is paired that is at the focal point of that first movable lens 204. As an example, and not by way of limitation, the adjustment mechanism 216 may be any mechanical apparatus driven using a driver board 212 and external controller 214. In particular embodiments, allowing the first light sources 202 to be moved to the focal point of the lenses 204 allows the lenses 204 of the lens array 206 to collimate the light of the first light sources 202 into parallel rays of light that together form a movable beam of light. Although this disclosure describes using particular mechanical components to move the first light sources 202 to the focal points of the respective lenses 204, this disclosure contemplates using any suitable mechanical components to move the first light sources 202 to the focal points of the respective lenses 204 in any suitable manner.

Figure 6A:
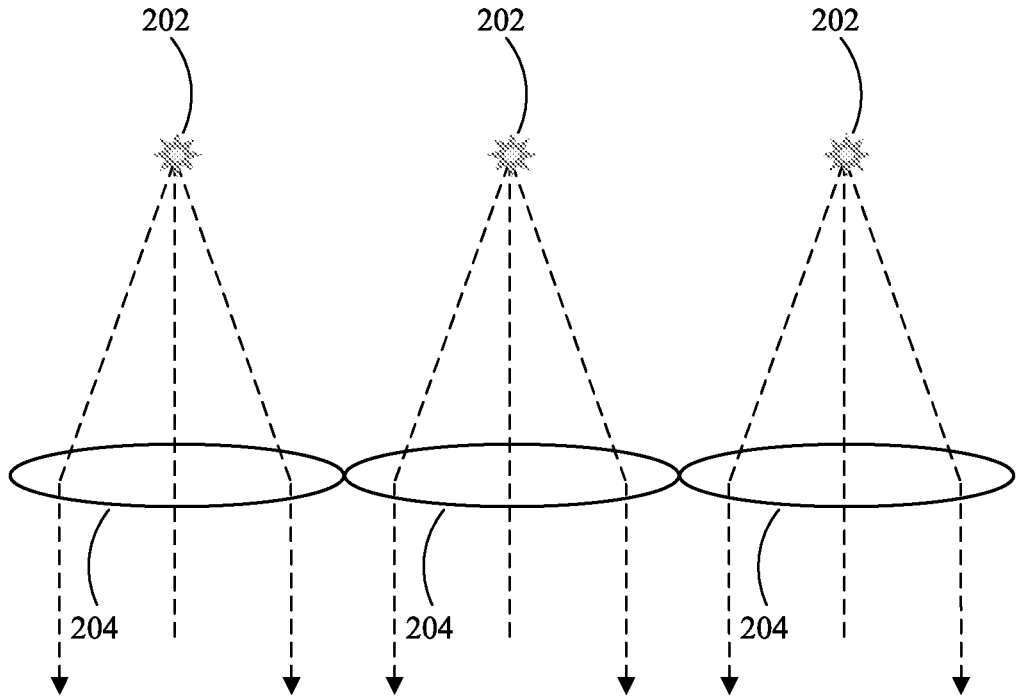
FIG. 6A illustrates a beam of light produced by a steerable lens array before the lens array has been steered.
Figure 6B:
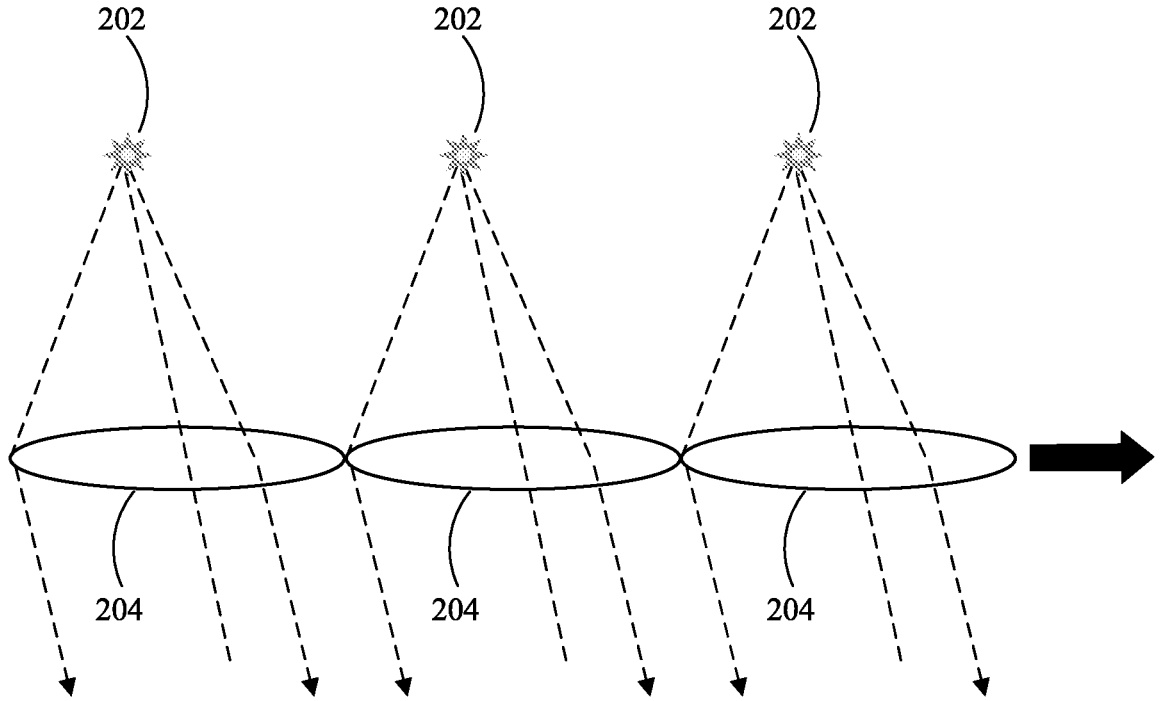
FIG. 6B illustrates steering a beam of light by moving lens array laterally.
Figure 7A:
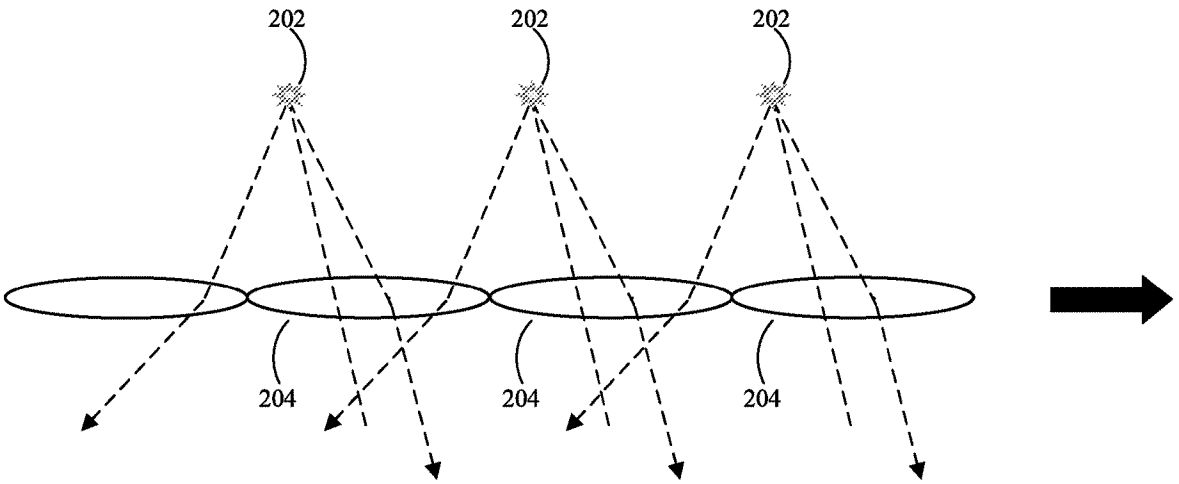
FIG. 7A illustrates unintended crosstalk in a single-depth lens array.

FIG. 6A illustrates a beam of light produced by a steerable lens array 206 before the lens array 206 has been steered. As depicted in FIG. 6A, each first light source-lens pair can be operable to generate a set of substantially parallel rays of light when each first light source 202 is positioned at approximately a focal point of the lens 204 with which it is paired. This may occur because each first light source 202 can shine on substantially only the lens 204 with which it is paired, as explained herein with more specificity. Thus, the interior luminaire system 190 can be operable to generate a substantially collimated beam of light comprising the sets of substantially parallel rays of light. However, in particular embodiments, the lenses 204 of the lens array 206 may also be steered laterally to move the substantially collimated beam of light laterally. Hence, the substantially collimated beam of light may be referred to as a "movable" beam of light. FIG. 6B illustrates steering a beam of light by moving the lens array 206 laterally. FIG. 6A and FIG. 6B are simplified drawings intended to focus on the lateral steering aspects, but the other components of the luminaire system depicted in FIG. 5 may also be present in particular embodiments. FIG. 6B depicts how the lateral steering of the lens array 206 moves the light emitted from the first light sources 202 away from the focal points of the lenses 204, thereby shifting the angle of the substantially collimated beam of light provided by the lens array 206. However, in particular embodiments, steering the lens array 206 as such may cause some of the light of a first light source 202 to be directed at a lens 204 that it is not paired with, effectively introducing a level of "crosstalk." FIG. 7A illustrates this unintended crosstalk in a single-depth lens array 206 of lenses 204.

Figure 7B:
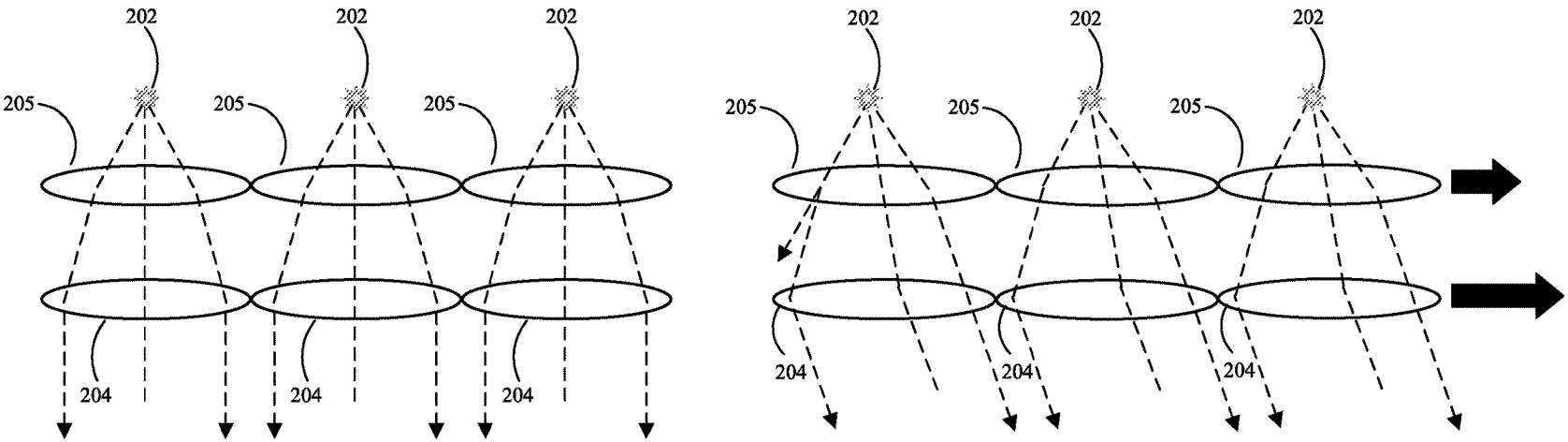
FIG. 7B illustrates how second movable lenses can eliminate or reduce crosstalk.

Hence, in particular embodiments, the lens array 206 may further comprise one or more second movable lenses 205, wherein each of the one or more second movable lenses 205 is paired with one of the one or more first movable lenses 204, respectively, and wherein each of the one or more second movable lenses 205 is configured to receive light substantially only from the respective paired first movable lens 204. FIG. 7B illustrates how second movable lenses 205 can eliminate or reduce crosstalk.

Referring again to FIG. 5, in particular embodiments, the interior luminaire system 190 may comprise additional components such as a low-profile heat sink 208 and a diffusing layer 210. In particular embodiments, the low-profile heat sink 208 can be used to absorb excess heat emitted by the interior luminaire system 190. In particular embodiments, the diffusing layer 210 can be controlled by electronic device 100 which is programmed to make the emulated sunlight more diffuse at certain times of the day, mimicking natural sunlight.

Figure 8:
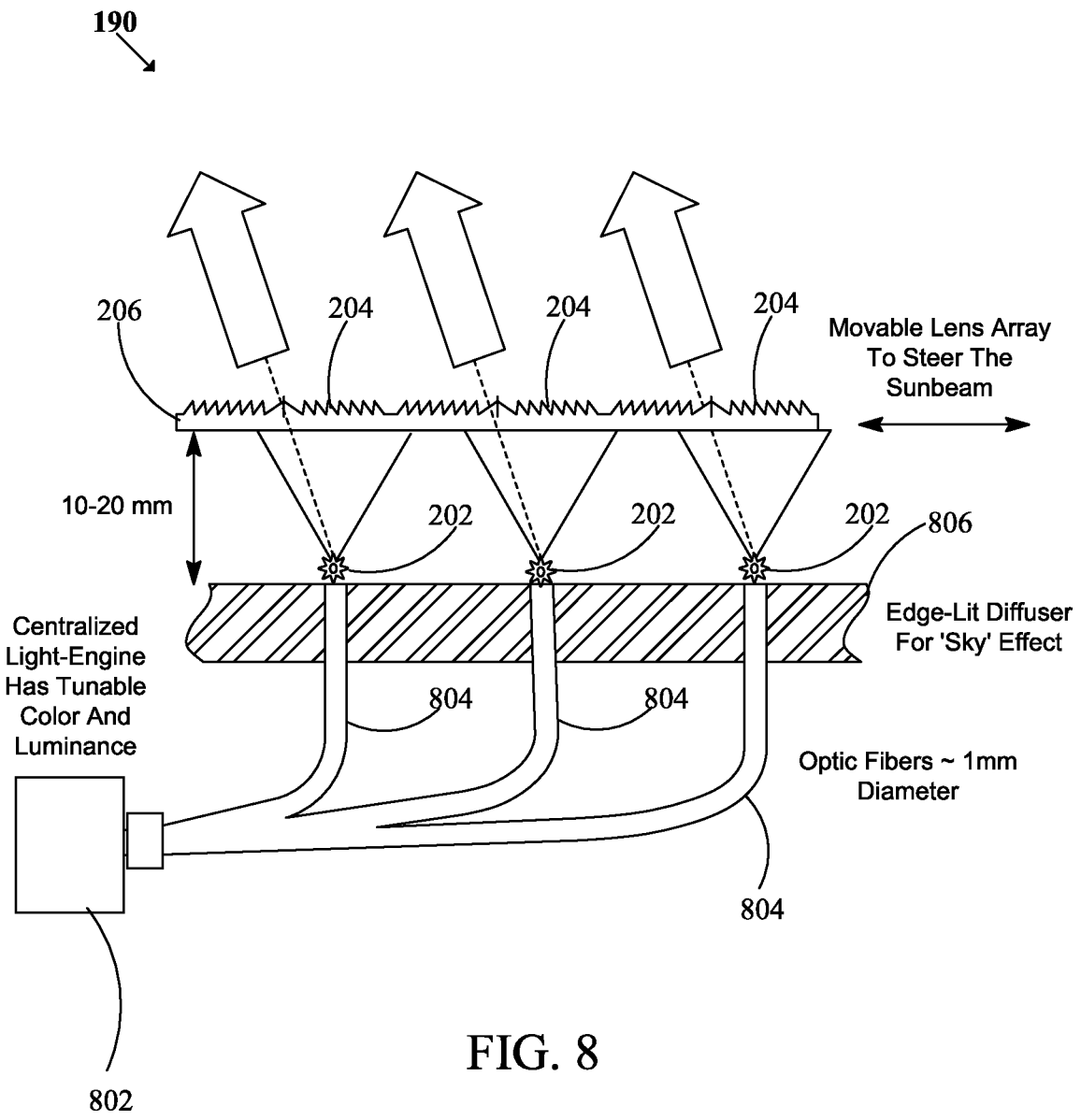
FIG. 8 illustrates a third example interior luminaire system using a centralized light-engine.

In particular embodiments, the interior luminaire system 190 comprises a centralized light engine 802 that powers each of the one or more first light sources 202, and wherein the centralized light engine 802 is tunable for color and luminescence. FIG. 8 illustrates a third example interior luminaire system 190 using a centralized light-engine 802. In particular embodiments, one or more optic fibers 804 may connect the centralized light-engine 802 to the one or more first light sources 202. As an example, and not by way of limitation, the optics fibers 804 may be between 0.1 and 2.0 millimeters thick and the movable lens array 206 may be 10 to 20 millimeters from the first light sources 202. In particular embodiments, an edge-lit diffuser 806 may be used as a second light source 203 to generate emulated skylight. As an example, and not by way of limitation, the edge-lit diffuser 806 may be similar to a panel as might be used in a television or a computer monitor. In particular embodiments, the edge-lit diffuser 806 may comprise edge-lighting LEDs that are color tunable to allow the color and intensity of the panel 806 to be adjusted. In particular embodiments, because the fiber 804 penetrations are spatially dilute, they do not interfere with the light diffusion. In particular embodiments, the optic fibers 806 penetrate the panel used for the sky effect and terminate at its front surface. In particular embodiments, the numerical aperture of the fibers 804 are selected so that the light emerges into a restricted emission cone (to match the numerical aperture of the lens 204), without the need of an additional restriction component. As an example, and not by way of limitation, the light-engine 802 may be a 30 W, color-tunable LED, or an incandescent source with a color-filter wheel. Although this disclosure describes incorporating a centralized light-engine 802 into an interior luminaire system 190 in a particular manner, this disclosure contemplates incorporating a centralized light-engine 802 into an interior luminaire system 190 in any suitable manner.

Figure 9:
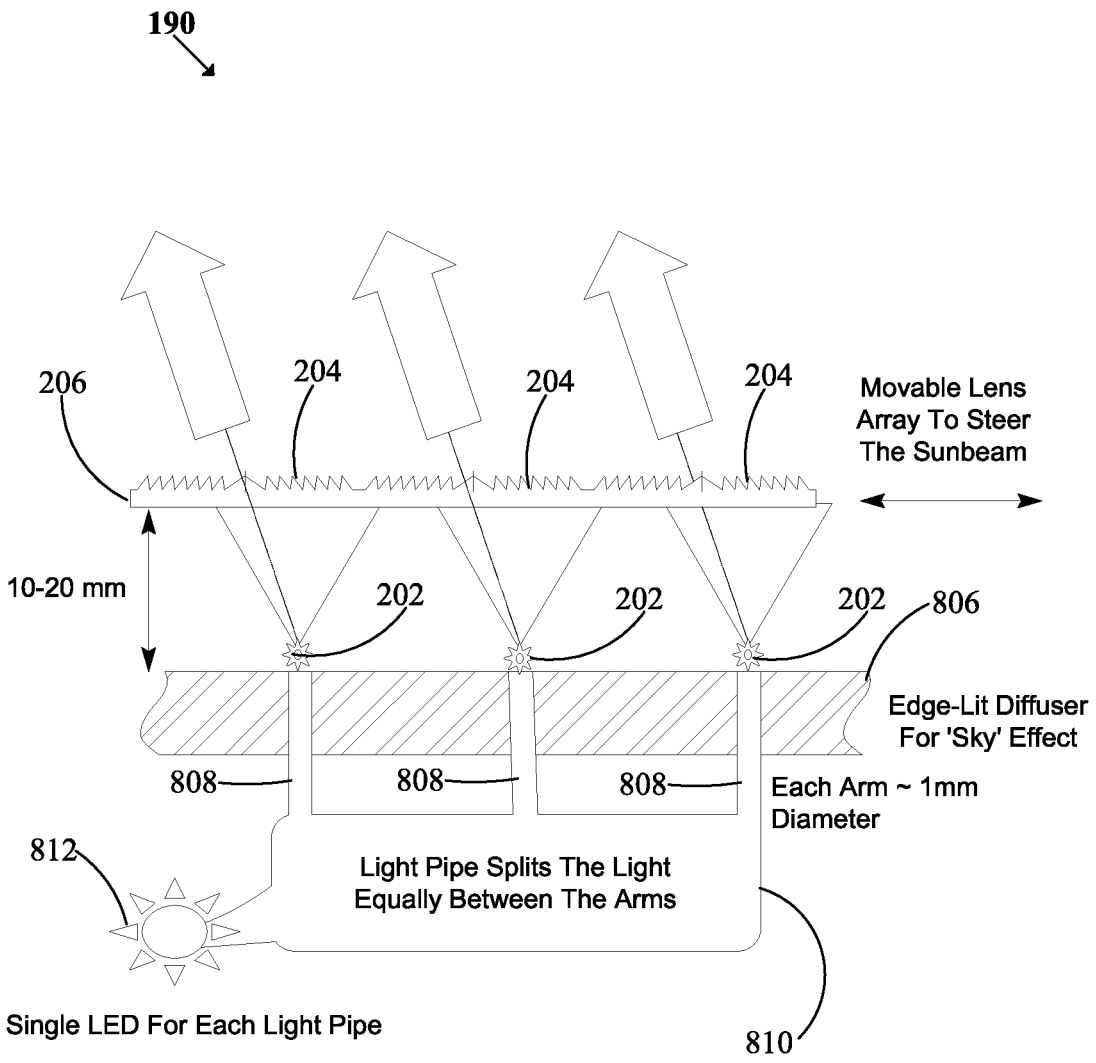
FIG. 9 illustrates a fourth example interior luminaire system using light pipes.

FIG. 9 illustrates a fourth example interior luminaire system using light pipes. FIG. 9 illustrates an alternative approach to generating the emulated sunlight via an optic-fiber fan-out approach as shown and described in reference to FIG. 8. In particular embodiments, instead of a bundle of optic fibers 804 connecting a common light source 802 to a perforated diffuser panel 806, this design uses a multitude of light pipes 810, each light pipe 810 comprising one or more arms 808. In particular embodiments, each light pipe has an independent LED 812 and is designed to split the light equally between several arms 808. As an example, and not by way of limitation, each pipe 810 may have 10 arms 808, but this value could range from 2-20 in various embodiments. Each arm 808 may be effectively the equivalent to one optic fiber 806 as depicted in and described in reference to FIG. 8. The light pipe 810 design of FIG. 9 can provide potential benefits in terms of ease of manufacturing. Although this disclosure describes light pipes 810 into an interior luminaire system 190 in a particular manner, this disclosure contemplates incorporating light pipes 810 into an interior luminaire system 190 in any suitable manner.

In particular embodiments, the interior luminaire system 190 may comprise an artificial skylight system comprising one or more second light sources 203, wherein each second light source 203 is operable to generate omnidirectional rays of light, and wherein the artificial skylight system is operable to generate diffuse illumination. As explained further above, the one or more second light sources 203 of the artificial sky-light system may comprise a transparent panel 806 comprising optical scattering sites and color-tunable light emitting diodes (LEDs), and wherein the color-tunable LEDs are operable to provide edge-illumination. Thus, in particular embodiments, the one or more second light sources may be color-tunable LEDs (FIGS. 2-5) or a transparent panel 806 edge-lit by color-tunable LEDs (FIGS. 8-9). But those embodiments are examples only. For example, in particular embodiments, the one or more second light sources 203 of the artificial skylight system comprise a transparent panel comprising a dilute concentration of one of blue fluorescent or blue phosphorescent particles, and wherein the particles are operable to be excited by edge illumination using ultraviolet (UV) light emitting diodes (LEDs). Moreover, in particular embodiments the one or more second light sources 203 of the artificial skylight system may comprise one or more tinted polymer-dispersed liquid crystal (PDLC) panels, and each of the one or more tinted PDLC panels may be operable to alter one or more characteristics of the diffuse illumination when a voltage is applied to that panel.

In particular embodiments, the disclosure systems and methods for realistically mimicking 'real sunshine' streaming into a window. Throughout the course of the day the scattering of real sunlight by the atmosphere may change, due to the azimuth of the sun (at lower angles the sunlight traverses a longer path through the atmosphere), or due to mist, clouds, smoke, rain, or other atmospheric conditions. Additionally, with increased atmospheric scattering, the 'sharpness' of shadows may change. In the case of very high scattering by clouds on an overcast day, the lighting becomes very diffused and the shadows may be absent. Particular embodiments include a method for mimicking these variable scattering effects. Particular embodiments include optical devices with scattering properties that can be changed under electrical control programmatically determined using electronic device 100, including liquid-crystals (of several classes), including Polymer-Dispersed-Liquid-Crystals (PDLCs). In particular embodiments, color-tinted PDLCs can be used to modify the color of light to mimic sky-color changes throughout a day. In particular embodiments, an electrically controlled PDLC film can be placed on the outside of the interior luminaire system 190 to modify the emitted light, and to emulate variable atmospheric scattering.

Figures 10A, 10B, 10C:
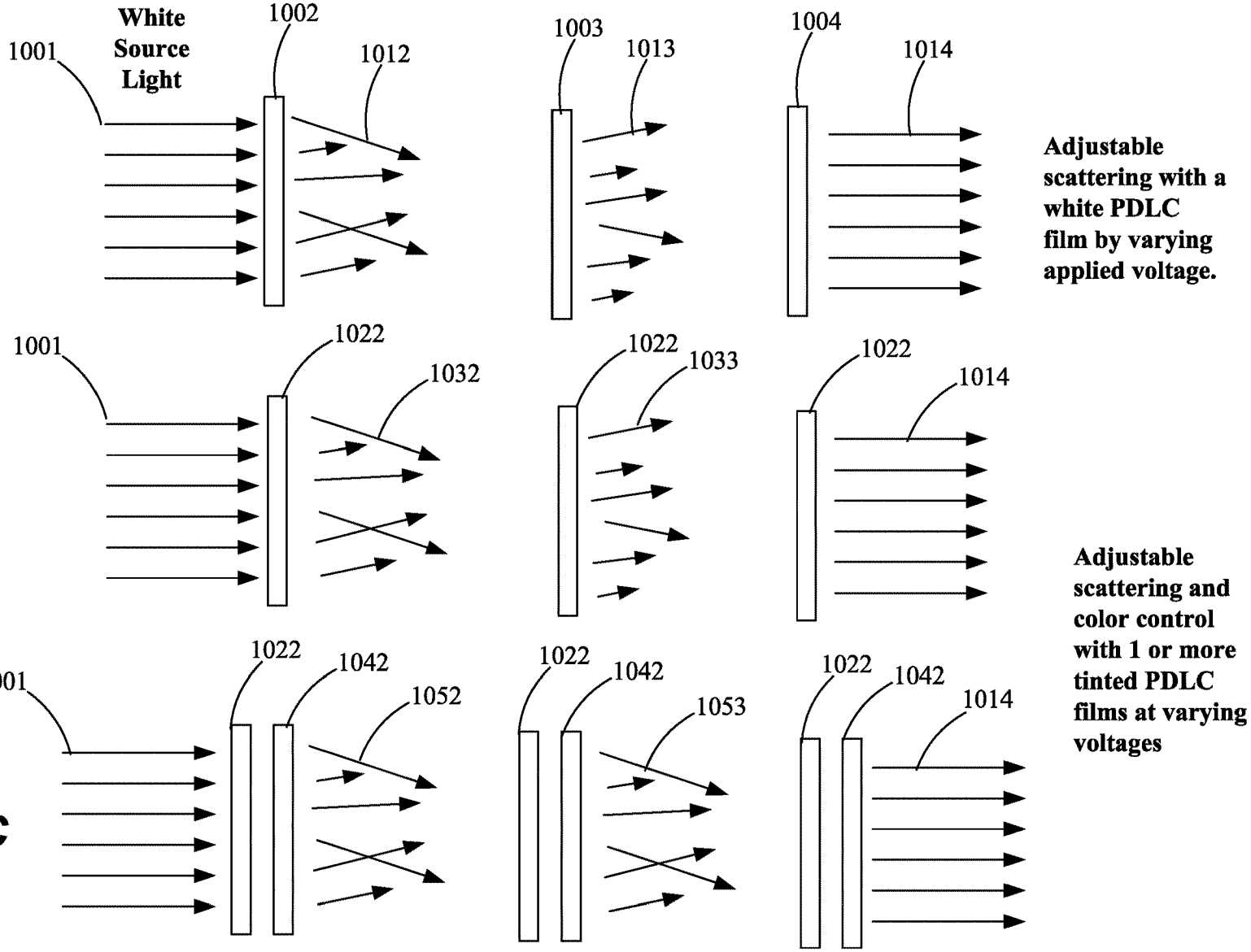
FIG. 10A illustrates adjustable scattering with a white light source and a white PDLC film by varying an applied voltage.
FIG. 10B illustrates adjustable scattering with a white light source and a first color PDLC film by varying an applied voltage.
FIG. 10C illustrates adjustable color control with a white light source, a first color PDLC film, and a second color PDLC film by varying applied voltages.

FIG. 10A illustrates adjustable scattering with a white light source 1001 and a white PDLC film 1002 by varying an applied voltage. FIG. 10A depicts that when light from a white light source 1001 hits a white PDLC film 1002 with a high voltage applied to the film 1002, then it can produce highly scattered white light 1012. However, when light from the white light source 1001 hits the white PDLC film 1002 with a moderate voltage less than the high voltage applied to the film 1002, then it can produce moderately scattered white light 1013 which is scattered less than the highly scattered white light 1012. Finally, when light from the white light source 1001 hits the white PDLC film 1002 with no voltage applied to the film 1002, then it can produce white light which is not scattered at all 1014.

FIG. 10B illustrates adjustable scattering with a white light source 1001 and a first color PDLC film 1022 by varying an applied voltage. FIG. 10B depicts that when light from a white light source 1001 hits a first color PDLC film 1022 with a high voltage applied to the film 1022, then it can produce highly scattered light of the first color 1032. However, when light from the white light source 1001 hits the first color PDLC film 1022 with a moderate voltage less than the high voltage applied to the film 1022, then it can produce moderately scattered light of the first color 1033 which is scattered less than the highly scattered light of the first color 1032. The moderately scattered light of the first color 1033 may be a lighter shade of the first color than the highly scattered light of the first color 1032. Finally, when light from the white light source 1001 hits the first color PDLC film 1022 with no voltage applied to the film 1022, then it can produce white light which is not scattered at all 1014.

FIG. 10C illustrates adjustable color control with a white light source 1001, a first color PDLC film 1022, and a second color PDLC film 1042 by varying applied voltages. When a voltage is applied to the first color PDLC film 1022, but not the second color PDLC film 1042, then light from the white light source 1001 is scattered when passing through the films and can emerge as scattered light of the first color 1052. Conversely, when a voltage is applied to the second color PDLC film 1042, but not the first color PDLC film 1022, then light from the white light source 1001 is scattered when passing through the films and can emerge as scattered light of the second color 1053. However, when no voltage is applied to either the first PDLC film 1022 or the second PDLC film 1042, then light from the white light source 1001 is not scattered when passing through the films and can emerge as white light which is not scattered at all 1014. Although this disclosure describes using PDLC films to adjust the level of scattering and color of light in particular ways, this disclosure contemplates using PDLC films to adjust the level of scattering and color of light in any suitable ways.

Further, in particular embodiments, by careful time synchronization for switching the PDLC and the 'sun' source, it is possible to scatter the emulated skylight, without scattering the emulated sunlight. Moreover, in particular embodiments, it is possible to use a blue-tinted PDLC to produce diffuse skylight light directly from the collimated emulated sunlight. Particular embodiments accomplish the foregoing using pulse width modulation (PWM), which may be understood as a sequence of square electrical pulses with a variable ON/OFF ratio.

Figure 11A:
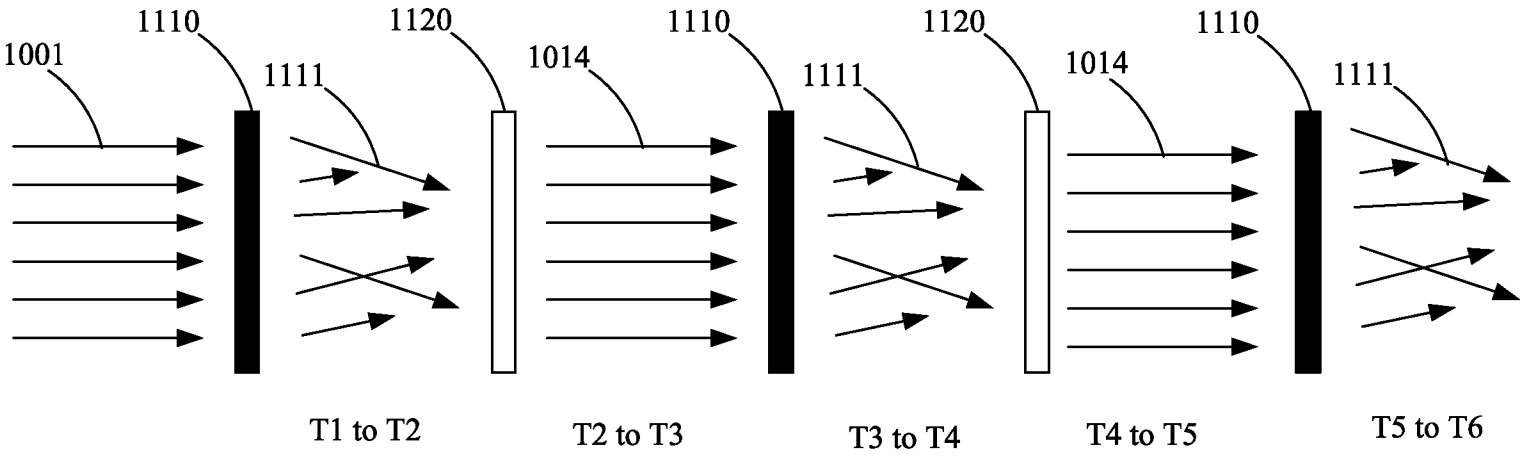
FIG. 11A illustrates pulse width modification (PWM) control of a PDLC sheet to produce diffuse colored backlight and collimated sunlight with one light source.
Figure 11B:
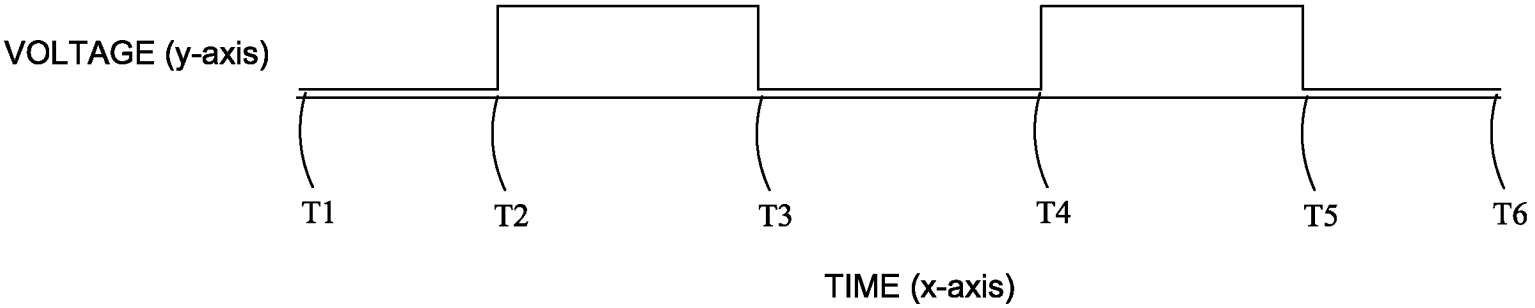
FIG. 11B illustrates a graph of a duty cycle corresponding to the output depicted in FIG. 11A.

FIG. 11A illustrates PWM control of a PDLC sheet to produce diffuse colored backlight and collimated sunlight with one light source. A duty cycle determined by electronic device 100 can change the relative brightness of collimated and scattered light, while using different voltages can adjust the color and scattering intensity. FIG. 11 shows that when light from a white light source 1001 passes through a first color PDLC sheet with a voltage applied 1110, then the output is scattered light of the first color 1111. FIG. 11 also shows that when light from a white light source 1001 passes through a first color PDLC sheet with no voltage applied 1120, then the output is white light which is not scattered at all 1014. FIG. 11B illustrates a graph of a duty cycle corresponding to the output depicted in FIG. 11A. In FIG. 11B, the x-axis represents time, while the y-axis represents voltage. In the depicted example of FIG. 11A and FIG. 11B, a voltage is applied to the PDLC at the times from T1 to T2, T3 to T4, and T5 to T6, but there is no voltage applied to the PDLC at the times from T2 to T3 and T4 to T5. Thus, in particular embodiments, the emulated sunlight and the emulated can be created by a single type of light source (e.g., the first light source 202), for example, using LEDs. The light 1111 that is generated by the first color PDLC sheet with a voltage applied 1110 is the emulated skylight, which can be diffuse and colored (e.g., blue). And the light 1014 that is generated by the first color PDLC sheet with no voltage applied 1120 is the emulated sunlight, which can be substantially collimated and white. In particular embodiments, as long as the frequency of the pulses is high enough, when the two types of emitted light, 1111, 1014 hit the human eye, there will be no perceptible irregularity and the viewer will perceive both the emulated skylight and the emulated sunlight. As an example, and not by way of limitation, the frequency of the pulses may be 60-100 Hz or more. Although this disclosure describes using PWM control of a PDLC sheet to produce diffuse colored backlight and collimated sunlight with one light source in a particular manner, this disclosure contemplates using PWM control of a PDLC sheet to produce diffuse colored backlight and collimated sunlight with one light source in any suitable manner.

Figure 12:
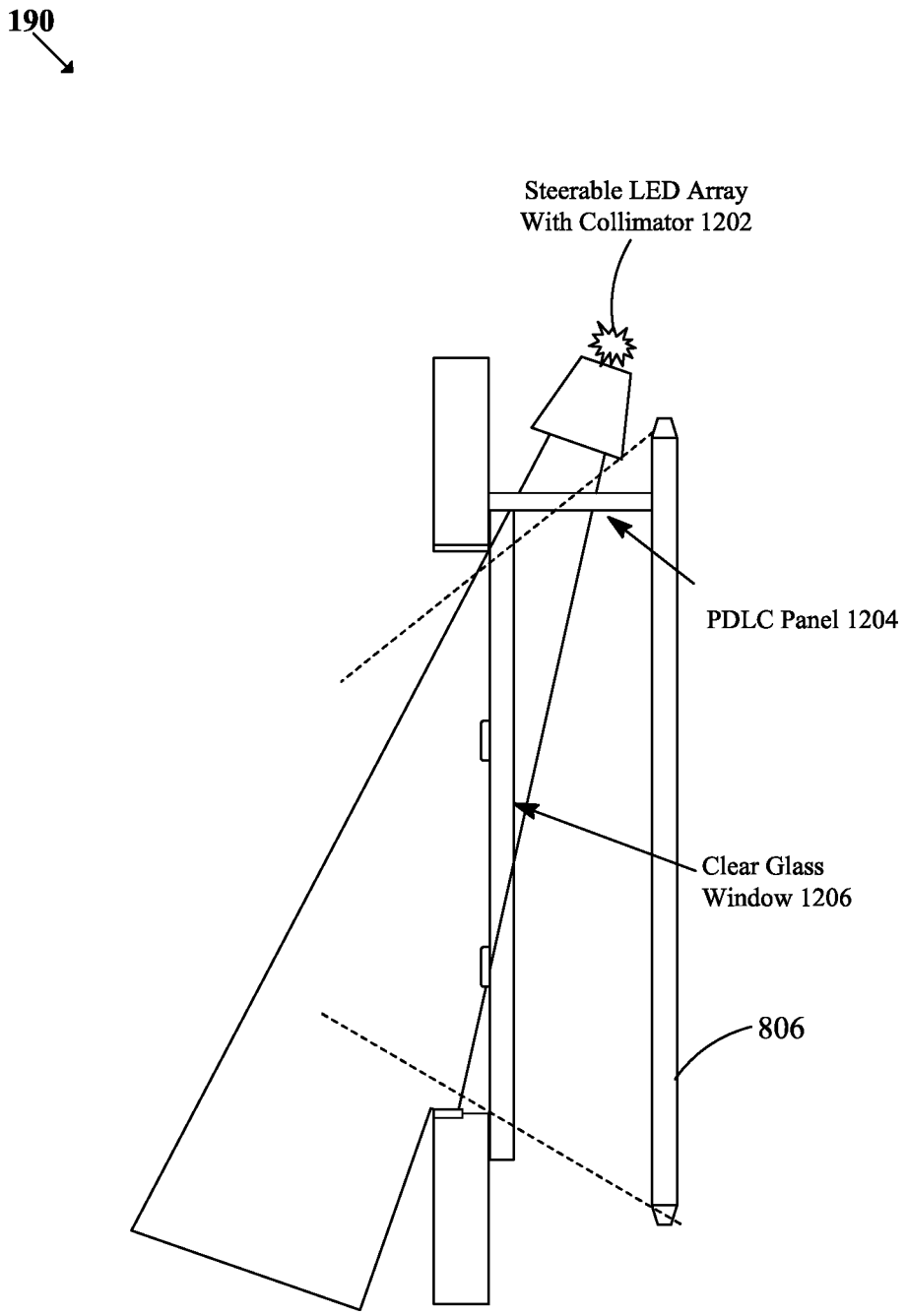
FIG. 12 illustrates a fifth example interior luminaire system using a steerable LED array with a collimator.

FIG. 12 illustrates a fifth example interior luminaire system 190 using a steerable LED array with a collimator 1202. Particular embodiments may include an edge-lit diffusion panel 806, as well as a as a panel with a PDLC film 1204 for controllable scattering as described in reference to FIGS. 10-11. As depicted, particular embodiments can provide an oblique illumination into a room, without the viewer seeing the 'sun' that provides the emulated sunlight directly. In particular embodiments, the emulated 'sun' can be placed at the edge of the panel and be obliquely angled into a room. In particular embodiments, the source of the emulated sunlight can be LEDs or another first light source 202. In particular embodiments, the 'sun' source can be a single element or an array of elements. In particular embodiments, the emulated sunlight can be collimated by using individual lenses, lens arrays, mirrors or total-internal-reflection (TIR) parabolic reflectors. In the depicted embodiment, the source consists of an array of LEDs each collimated by a plastic TIR reflector 1202. In the depicted embodiment, the motion of the source can be achieved by a mechanical linkage—all the TIR reflectors can be ganged together so they move in parallel. In particular embodiments, the emulated sunlight can pass through a clear glass window 1206 after passing through the PDLC panel 1204. In particular embodiments, the window may have features to give a parallax effect against the diffuser panel 806. In particular embodiments, the diffuser panel 806 size may be larger than opening to help with the illusion of depth. Thus, in particular embodiments, an emulated 'sun' cannot be seen directly by a viewer, but a beam of sunshine may appear to illuminate surrounding walls. Although this disclosure describes providing an oblique window impression to a viewer in a particular manner, this disclosure contemplates producing an oblique window impression in any suitable manner.

As explained, further herein throughout this disclosure, the disclosure also provides various methods of using an interior luminaire system 190. Wherein the one or more second light sources 203 of the artificial sky-light system comprise one or more tinted polymer-dispersed liquid crystal (PDLC) panels, one example method comprises applying a voltage to each of the one or more tinted PDLC panels to alter one or more characteristics of the diffuse illumination. Wherein each first light source 202 and each second light source 203 is tunable for color another example method comprises changing, over a pre-determined time, a respective emission color of each of the first light sources 202 within an approximate black-body curve to emulate a solar spectrum; and changing, over the pre-determined time, a respective emission color of each of the second light sources 203 to emulate skylight, wherein the emulated skylight comprises natural variations in skylight color caused by changing environmental conditions. Wherein the one or more first movable lenses 204 are positioned in an array 206, another example method comprises moving, over a pre-determined time, the array 206 to change a direction of the substantially collimated beam of light to emulate a natural movement of the sun, wherein the array 206 is moved by translating a position of each first light source 202 relative to the lens 204 with which it is paired. Although this disclosure describes using an interior luminaire system 190 in particular manners, this disclosure contemplates using an interior luminaire system 190 in any suitable manner.

Figure 13:
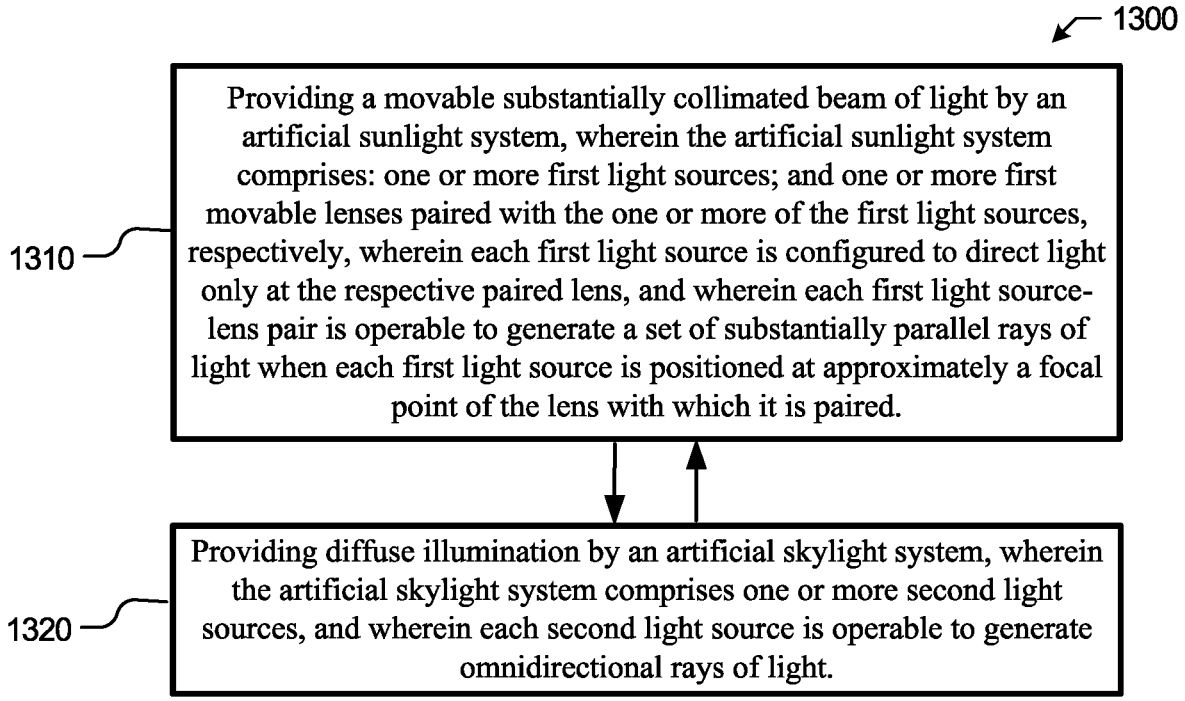
FIG. 13 illustrates an example method for emulating natural daylight with an interior luminaire system.

FIG. 13 illustrates is a flow diagram of a method 1300 for emulating natural daylight with an interior luminaire, in accordance with the presently disclosed embodiments. The method 1300 may be performed utilizing one or more integrated or external processing devices (e.g., electronic device 100) that may include hardware (e.g., a general purpose processor, a graphic processing unit (GPU), an application-specific integrated circuit (ASIC), a system-on-chip (SoC), a microcontroller, a field-programmable gate array (FPGA), a central processing unit (CPU), an application processor (AP), a visual processing unit (VPU), a neural processing unit (NPU), a neural decision processor (NDP), or any other processing device(s) that may be suitable for processing 2D and 3D image data, software (e.g., instructions running/executing on one or more processors), firmware (e.g., microcode), or some combination thereof.

The method 1300 may begin at step 1310 with providing a movable substantially collimated beam of light by an artificial sunlight system, wherein the artificial sunlight system comprises: one or more first light sources; and one or more first movable lenses paired with the one or more of the first light sources, respectively, wherein each first light source is configured to direct light only at the respective paired lens, and wherein each first light source-lens pair is operable to generate a set of substantially parallel rays of light when each first light source is positioned at approximately a focal point of the lens with which it is paired. The method 1300 may then continue at step 1320 with providing diffuse illumination by an artificial skylight system, wherein the artificial skylight system comprises one or more second light sources, and wherein each second light source is operable to generate omnidirectional rays of light.

Particular embodiments may repeat one or more steps of the method of FIG. 13, where appropriate. Although this disclosure describes and illustrates particular steps of the method of FIG. 13 as occurring in a particular order, this disclosure contemplates any suitable steps of the method of FIG. 13 occurring in any suitable order. Moreover, although this disclosure describes and illustrates an example method for emulating natural daylight with an interior luminaire including the particular steps of the method of FIG. 13, this disclosure contemplates any suitable method for emulating natural daylight with an interior luminaire including any suitable steps, which may include all, some, or none of the steps of the method of FIG. 13, where appropriate. Furthermore, although this disclosure describes and illustrates particular components, devices, or systems carrying out particular steps of the method of FIG. 13, this disclosure contemplates any suitable combination of any suitable components, devices, or systems carrying out any suitable steps of the method of FIG. 13.

Systems and Methods

Figure 14:
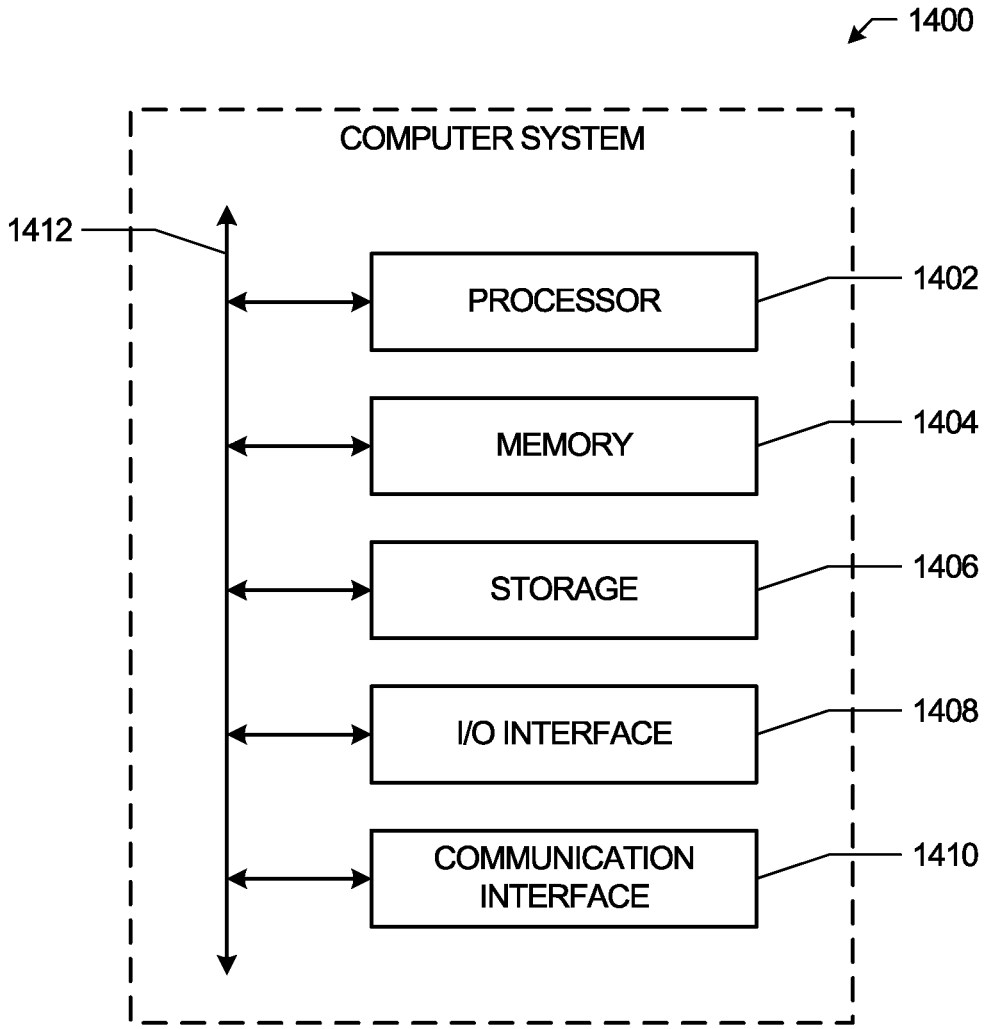
FIG. 14 illustrates an example computer system.

FIG. 14 illustrates an example computer system 1400 that may be utilized to perform emulating natural daylight with an interior luminaire, in accordance with the presently disclosed embodiments. In particular embodiments, one or more computer systems 1400 perform one or more steps of one or more methods described or illustrated herein. In particular embodiments, one or more computer systems 1400 provide functionality described or illustrated herein. In particular embodiments, software running on one or more computer systems 1400 performs one or more steps of one or more methods described or illustrated herein or provides functionality described or illustrated herein. Particular embodiments include one or more portions of one or more computer systems 1400. Herein, reference to a computer system may encompass a computing device, and vice versa, where appropriate. Moreover, reference to a computer system may encompass one or more computer systems, where appropriate.

This disclosure contemplates any suitable number of computer systems 1400. This disclosure contemplates computer system 1400 taking any suitable physical form. As example and not by way of limitation, computer system 1400 may be an embedded computer system, a system-on-chip (SOC), a single-board computer system (SBC) (e.g., a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 1400 may include one or more computer systems 1400; be unitary or distributed; span multiple locations; span multiple machines; span multiple data centers; or reside in a cloud, which may include one or more cloud components in one or more networks.

Where appropriate, one or more computer systems 1400 may perform without substantial spatial or temporal limitation one or more steps of one or more methods described or illustrated herein. As an example, and not by way of limitation, one or more computer systems 1400 may perform in real time or in batch mode one or more steps of one or more methods described or illustrated herein. One or more computer systems 1400 may perform at different times or at different locations one or more steps of one or more methods described or illustrated herein, where appropriate.

In particular embodiments, computer system 1400 includes a processor 1402, memory 1404, storage 1406, an input/output (I/O) interface 1408, a communication interface 1410, and a bus 1412. Although this disclosure describes and illustrates a particular computer system having a particular number of particular components in a particular arrangement, this disclosure contemplates any suitable computer system having any suitable number of any suitable components in any suitable arrangement. In particular embodiments, processor 1402 includes hardware for executing instructions, such as those making up a computer program. As an example, and not by way of limitation, to execute instructions, processor 1402 may retrieve (or fetch) the instructions from an internal register, an internal cache, memory 1404, or storage 1406; decode and execute them; and then write one or more results to an internal register, an internal cache, memory 1404, or storage 1406. In particular embodiments, processor 1402 may include one or more internal caches for data, instructions, or addresses. This disclosure contemplates processor 1402 including any suitable number of any suitable internal caches, where appropriate. As an example, and not by way of limitation, processor 1402 may include one or more instruction caches, one or more data caches, and one or more translation lookaside buffers (TLBs). Instructions in the instruction caches may be copies of instructions in memory 1404 or storage 1406, and the instruction caches may speed up retrieval of those instructions by processor 1402.

Data in the data caches may be copies of data in memory 1404 or storage 1406 for instructions executing at processor 1402 to operate on; the results of previous instructions executed at processor 1402 for access by subsequent instructions executing at processor 1402 or for writing to memory 1404 or storage 1406; or other suitable data. The data caches may speed up read or write operations by processor 1402. The TLBs may speed up virtual-address translation for processor 1402. In particular embodiments, processor 1402 may include one or more internal registers for data, instructions, or addresses. This disclosure contemplates processor 1402 including any suitable number of any suitable internal registers, where appropriate. Where appropriate, processor 1402 may include one or more arithmetic logic units (ALUs); be a multi-core processor; or include one or more processors 1402. Although this disclosure describes and illustrates a particular processor, this disclosure contemplates any suitable processor.

In particular embodiments, memory 1404 includes main memory for storing instructions for processor 1402 to execute or data for processor 1402 to operate on. As an example, and not by way of limitation, computer system 1400 may load instructions from storage 1406 or another source (such as, for example, another computer system 1400) to memory 1404. Processor 1402 may then load the instructions from memory 1404 to an internal register or internal cache. To execute the instructions, processor 1402 may retrieve the instructions from the internal register or internal cache and decode them. During or after execution of the instructions, processor 1402 may write one or more results (which may be intermediate or final results) to the internal register or internal cache. Processor 1402 may then write one or more of those results to memory 1404. In particular embodiments, processor 1402 executes only instructions in one or more internal registers or internal caches or in memory 1404 (as opposed to storage 1406 or elsewhere) and operates only on data in one or more internal registers or internal caches or in memory 1404 (as opposed to storage 1406 or elsewhere).

One or more memory buses (which may each include an address bus and a data bus) may couple processor 1402 to memory 1404. Bus 1412 may include one or more memory buses, as described below. In particular embodiments, one or more memory management units (MMUs) reside between processor 1402 and memory 1404 and facilitate accesses to memory 1404 requested by processor 1402. In particular embodiments, memory 1404 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1404 may include one or more memory devices 1404, where appropriate. Although this disclosure describes and illustrates particular memory, this disclosure contemplates any suitable memory.

In particular embodiments, storage 1406 includes mass storage for data or instructions. As an example, and not by way of limitation, storage 1406 may include a hard disk drive (HDD), a floppy disk drive, flash memory, an optical disc, a magneto-optical disc, magnetic tape, or a Universal Serial Bus (USB) drive or a combination of two or more of these. Storage 1406 may include removable or non-removable (or fixed) media, where appropriate. Storage 1406 may be internal or external to computer system 1400, where appropriate. In particular embodiments, storage 1406 is non-volatile, solid-state memory. In particular embodiments, storage 1406 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1406 taking any suitable physical form. Storage 1406 may include one or more storage control units facilitating communication between processor 1402 and storage 1406, where appropriate. Where appropriate, storage 1406 may include one or more storages 1406. Although this disclosure describes and illustrates particular storage, this disclosure contemplates any suitable storage.

In particular embodiments, I/O interface 1408 includes hardware, software, or both, providing one or more interfaces for communication between computer system 1400 and one or more I/O devices. Computer system 1400 may include one or more of these I/O devices, where appropriate.

One or more of these I/O devices may enable communication between a person and computer system 1400. As an example, and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 1406 for them. Where appropriate, I/O interface 1408 may include one or more device or software drivers enabling processor 1402 to drive one or more of these I/O devices. I/O interface 1408 may include one or more I/O interfaces 1406, where appropriate. Although this disclosure describes and illustrates a particular I/O interface, this disclosure contemplates any suitable I/O interface.

In particular embodiments, communication interface 1410 includes hardware, software, or both providing one or more interfaces for communication (such as, for example, packet-based communication) between computer system 1400 and one or more other computer systems 1400 or one or more networks. As an example, and not by way of limitation, communication interface 1410 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 1410 for it.

As an example, and not by way of limitation, computer system 1400 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1400 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 1400 may include any suitable communication interface 1410 for any of these networks, where appropriate. Communication interface 1410 may include one or more communication interfaces 1410, where appropriate. Although this disclosure describes and illustrates a particular communication interface, this disclosure contemplates any suitable communication interface.

In particular embodiments, bus 1412 includes hardware, software, or both coupling components of computer system 1400 to each other. As an example, and not by way of limitation, bus 1412 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 1412 may include one or more buses 1412, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Miscellaneous

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Herein, "automatically" and its derivatives means "without human intervention," unless expressly indicated otherwise or indicated otherwise by context.

The embodiments disclosed herein are only examples, and the scope of this disclosure is not limited to them. Embodiments according to the invention are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. An interior luminaire system for emulating natural daylight comprising:

a luminaire housing containing:

an artificial sunlight system comprising:

one or more first light sources; and one or more first movable lenses paired with the one or more of the first light sources, respectively, wherein each first light source is configured to direct light only at the respective paired lens, wherein each first light source-lens pair is operable to generate a set of substantially parallel rays of light when each first light source is positioned at approximately a focal point of the lens with which it is paired, and wherein the artificial sunlight system is operable to generate a movable substantially collimated beam of light comprising the sets of substantially parallel rays of light; and an artificial skylight system comprising one or more second light sources, wherein each second light source is operable to generate omnidirectional rays of light, and wherein the artificial skylight system is operable to generate diffuse illumination, wherein the substantially collimated beam of light from the artificial sunlight system and the diffuse illumination from the artificial skylight system each pass through at least a portion of the luminaire housing.

2. The system of claim 1, wherein each of the one or more first light sources of the artificial sunlight system is a color-tunable light emitting diode (LED), and wherein each LED is tunable to emulate a solar spectrum by changing, over a pre-determined time, a respective emission color of each LED within an approximate black-body curve.

3. The system of claim 1, wherein the one or more second light sources of the artificial skylight system comprise a transparent panel comprising optical scattering sites and color-tunable light emitting diodes (LEDs), and wherein the color-tunable LEDs are operable to provide edge-illumination.

4. The system of claim 1, wherein the one or more first light sources and the one or more second light sources comprise color-tunable light emitting diodes (LEDs) positioned in a first array, and wherein each of the one or more second light sources is positioned at a respective location outside a focal area of each of the first movable lenses.

5. The system of claim 4, wherein each first light source further comprises an integral lens that restricts an emission angle of that first light source.

6. The system of claim 4, wherein the one or more first movable lenses are positioned in a second array, wherein the second array is steerable and can translate with at least two degrees of freedom, and wherein the artificial sunlight system is operable to move the substantially collimated beam of light by steering the second array.

7. The system of claim 6, wherein the second array further comprises one or more second movable lenses, wherein each of the one or more second movable lenses is paired with one of the one or more first movable lenses, respectively, and wherein each of the one or more second movable lenses is configured to receive light substantially only from the respective paired first movable lens.

8. The system of claim 1, wherein the one or more second light sources of the artificial skylight system comprise a transparent panel comprising a dilute concentration of one of blue fluorescent or blue phosphorescent particles, and wherein the particles are operable to be excited by edge illumination using ultraviolet (UV) light emitting diodes (LEDs).

9. The system of claim 1, wherein the one or more second light sources of the artificial skylight system comprise one or more tinted polymer-dispersed liquid crystal (PDLC) panels, and wherein each of the one or more tinted PDLC panels is operable to alter one or more characteristics of the diffuse illumination when a voltage is applied to that panel.

10. The system of claim 1, wherein the artificial sunlight system further comprises a centralized light engine that powers each of the one or more first light sources, and wherein the centralized light engine is tunable for color and luminescence.

11. A method for emulating natural daylight comprising:

providing a movable substantially collimated beam of light by an artificial sunlight system, wherein the artificial sunlight system comprises a luminaire housing containing:

one or more first light sources; and one or more first movable lenses paired with the one or more of the first light sources, respectively, wherein each first light source is configured to direct light only at the respective paired lens, and wherein each first light source-lens pair is operable to generate a set of substantially parallel rays of light when each first light source is positioned at approximately a focal point of the lens with which it is paired; and providing diffuse illumination by an artificial skylight system, wherein the artificial skylight system comprises one or more second light sources, and wherein each second light source is operable to generate omnidirectional rays of light, wherein the substantially collimated beam of light from the artificial sunlight system and the diffuse illumination from the artificial skylight system each pass through at least a portion of the luminaire housing.

12. The method of claim 11, wherein the one or more second light sources of the artificial skylight system comprise one or more tinted polymer-dispersed liquid crystal (PDLC) panels, and wherein the method further comprises:

applying a voltage to each of the one or more tinted PDLC panels to alter one or more characteristics of the diffuse illumination.

13. The method of claim 11, wherein each first light source and each second light source is tunable for color, the method further comprising:

changing, over a pre-determined time, a respective emission color of each of the first light sources within an approximate black-body curve to emulate a solar spectrum; and changing, over the pre-determined time, a respective emission color of each of the second light sources to emulate skylight, wherein the emulated skylight comprises natural variations in skylight color caused by changing environmental conditions.

14. The method of claim 11, wherein the one or more first movable lenses are positioned in an array, the method further comprising:

moving, over a pre-determined time, the array to change a direction of the substantially collimated beam of light to emulate a natural movement of the sun;

wherein the array is moved by translating a position of each first light source relative to the lens with which it is paired.

15. The method of claim 11, further comprising:

moving each first light source to a position relative to the first movable lens with which it is paired that is at the focal point of that first movable lens.

16. A computer-readable non-transitory storage media comprising instructions executable by a processor to:

provide a movable substantially collimated beam of light by an artificial sunlight system, wherein the artificial sunlight system comprises a luminaire housing containing:

one or more first light sources; and one or more first movable lenses paired with the one or more of the first light sources, respectively, wherein each first light source is configured to direct light only at the respective paired lens, and wherein each first light source-lens pair is operable to generate a set of substantially parallel rays of light when each first light source is positioned at approximately a focal point of the lens with which it is paired; and provide diffuse illumination by an artificial skylight system, wherein the artificial skylight system comprises one or more second light sources, and wherein each second light source is operable to generate omnidirectional rays of light, wherein the substantially collimated beam of light from the artificial sunlight system and the diffuse illumination from the artificial skylight system each pass through at least a portion of the luminaire housing.

17. The storage media of claim 16, wherein the one or more second light sources of the artificial skylight system comprise one or more tinted polymer-dispersed liquid crystal (PDLC) panels, and wherein the storage media further comprises instructions operable by a processor to:

apply a voltage to each of the one or more tinted PDLC panels to alter one or more characteristics of the diffuse illumination.

18. The storage media of claim 16, wherein each first light source and each second light source is tunable for color, and wherein the storage media further comprises instructions operable by a processor to:

change, over a pre-determined time, a respective emission color of each of the first light sources within an approximate black-body curve to emulate a solar spectrum; and change, over the pre-determined time, a respective emission color of each of the second light sources to emulate skylight, wherein the emulated skylight comprises natural variations in skylight color caused by changing environmental conditions.

19. The storage media of claim 16, wherein the one or more first movable lenses are positioned in an array, and wherein the storage media further comprises instructions operable by a processor to:

move, over a pre-determined time, the array to change a direction of the substantially collimated beam of light to emulate a natural movement of the sun;

wherein the array is moved by translating a position of each first light source relative to the lens with which it is paired.

20. The storage media of claim 16, wherein the storage media further comprises instructions operable by a processor to:

move each first light source to a position relative to the first movable lens with which it is paired that is at the focal point of that first movable lens.

* * * * *